US006575547B2

(12) United States Patent
Sakuma

(10) Patent No.: US 6,575,547 B2
(45) Date of Patent: Jun. 10, 2003

(54) INKJET PRINTER

(75) Inventor: Katsuhisa Sakuma, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/814,515

(22) Filed: Mar. 22, 2001

(65) Prior Publication Data

US 2001/0043244 A1 Nov. 22, 2001

(30) Foreign Application Priority Data

Mar. 28, 2000 (JP) ..... 2000-089450

(51) Int. Cl.[7] ..... B41J 29/377; B41J 2/195
(52) U.S. Cl. ..... 347/18; 347/6
(58) Field of Search ..... 347/17, 18, 6, 347/7

(56) References Cited

U.S. PATENT DOCUMENTS

| | | | | | |
|---|---|---|---|---|---|
| 4,007,684 | A | * | 2/1977 | Takano et al. | 347/6 |
| 4,337,469 | A | | 6/1982 | Takano et al. | 347/7 |
| 4,459,469 | A | * | 7/1984 | Ishima | 347/17 |
| 4,660,058 | A | | 4/1987 | Cordery | 347/18 |
| 4,860,027 | A | * | 8/1989 | Ozelis et al. | 347/6 |
| 5,402,160 | A | * | 3/1995 | Kadowaki et al. | 347/18 |
| 5,485,182 | A | | 1/1996 | Takayanagi et al. | 347/17 |
| 5,502,467 | A | | 3/1996 | Hoisington et al. | 347/6 |
| 5,623,292 | A | * | 4/1997 | Shrivastava et al. | 347/18 |
| 6,007,193 | A | * | 12/1999 | Kashimura et al. | 347/92 |

FOREIGN PATENT DOCUMENTS

| | | | | |
|---|---|---|---|---|
| EP | 0819537 | | 1/1998 | |
| GB | 2288889 | | 11/1995 | |
| WO | WO-93-17870 | * | 9/1993 | B41J/2/195 |

* cited by examiner

*Primary Examiner*—John Barlow
*Assistant Examiner*—Blaise Mouttet
(74) *Attorney, Agent, or Firm*—Adams & Wilks

(57) ABSTRACT

An inkjet printer has an ink containing portion for containing ink, a driving portion having a nozzle for ejecting ink contained in the ink containing portion, and a first control circuit for driving and controlling the driving portion. An ink passage is disposed between the ink containing portion and the driving portion for supplying ink contained in the ink containing portion to the driving portion via an ink supply path extending from the ink containing portion through the ink passage to the driving portion. A connecting portion connects the ink passage to the printing unit. A heating portion is disposed in the ink supply path for heating the ink supplied to the driving portion. A cooling portion for cooling the ink is disposed in the ink supply path at a position closer to the driving portion than the heating portion. A temperature sensor portion for detecting the temperature of the ink supplied to the driving portion is disposed in the ink supply path at a position closer to the driving portion than the cooling portion. The heating portion, the cooling portion and the temperature sensor portion are disposed at the connecting portion. A second control circuit controls at least one of the heating portion and the cooling portion in accordance with the temperature of the ink detected by the temperature sensor portion to adjust and control the temperature of the ink before it is supplied to the driving portion.

10 Claims, 8 Drawing Sheets

INKJET PRINTER

BACKGROUND OF THE INVENTION

1. Field of the Invention

The present invention relates to an inkjet printer for printing by ejecting ink on a recording medium.

2. Description of the Related Art

FIG. 13 is a perspective view of a conventional inkjet printer which is shown in part. A reference numeral 1A denotes an ink containing portion where, for example, a replaceable ink cartridge formed of plastic for containing ink is built in a cartridge holder formed of plastic. A reference numeral 1C denotes a driving portion formed of, for example, a piezo element. A reference numeral 1B denotes an ink passage formed of, for example, plastic, for supplying the ink from the ink containing portion 1A to the driving portion 10 on an ink passage. A reference numeral 1D is a nozzle for expelling the ink connected to the driving portion 10 and formed of, for example, metal. A reference numeral 1E is an electrode formed of, for example, aluminum and is evaporated on both sides of a wall surface of the driving portion 10. A reference numeral 1F denotes an external circuit. A control program stored in a storage medium of the external circuit operates a CPU of the external circuit. By supplying the electrode 1E with a control voltage from an external power source which is not shown, a piezo wall of the driving portion 10 having the electrode 1E evaporated on both surfaces thereof, for example, a shaded portion in FIG. 13, is deformed regularly to generate in the driving portion 10 pressure for expelling the ink from the nozzle 1D. The series of operations are driven and controlled.

The ink conventionally used is water-based ink. When the ink jet printer is operated at room temperature, the viscosity of the ink is constant in a range from 5 m Pa·s to 8 m Pa·s. Therefore, it is not necessary to, for the purpose of attaining stable printing quality, adjust the temperature of the ink to control the viscosity of the ink.

In case the ink used in the conventional printer having the above system is oil-based, since the temperature of the ink before printing is started depends on the outside air temperature, the temperature of the ink is low and the viscosity of the ink is high in a low-temperature environment, while the temperature of the ink is high and the viscosity of the ink is low in a high-temperature environment. Therefore, when the ink is oil-based, the viscosity of the ink before the ink is supplied to the driving portion for expelling the ink fluctuates more due to the environmental temperature than a case where the ink is water-based. It follows that, in a case where the ink is oil-based, the range of temperatures where printing is possible with stable printing quality is narrower compared with a case where the ink is water-based.

SUMMARY OF THE INVENTION

In view of the above, an object of the present invention is, by heating or cooling the ink to control the temperature of the ink, before the ink flows in the driving portion, to always hold the viscosity of the ink in a state where the printing quality is stable even when the used ink is oil-based ink the viscosity of which varies considerably depending on the temperature of the ink, and, thereby, to widen the range of temperatures where printing is possible with stable printing quality.

In order to solve the above problem, an inkjet printer according to an embodiment of the present invention comprises a heating portion for heating ink, a cooling portion for cooling the ink, a temperature sensor portion for detecting a temperature of the ink, and a control portion for controlling at least one of the heating portion and the cooling portion correspondingly to the temperature detected by the temperature sensor portion to adjust and control the temperature of ink which flow in the driving portion. It is to be noted that the heating portion, the cooling portion, and the temperature sensor portion are provided at a position other than a driving portion for expelling the ink and are directly or indirectly in contact with the ink. This allows the control portion to control at least one of the heating portion and the cooling portion correspondingly to the temperature detected by the temperature sensor portion to hold constant the temperature of the ink before the ink flows in the driving portion. Thus it is possible to hold constant the viscosity of the ink before the ink flows in the driving portion. Therefore, even when oil-based ink is used the viscosity of which varies considerably depending on the environmental temperature, it is possible to widen the range of temperatures where printing is possible with stable printing quality.

In the inkjet printer according to the foregoing embodiment of the present invention, when the temperature of the ink detected by the temperature sensor exceeds an upper limit temperature, the control portion operates the cooling portion to cool the ink, and when the temperature of the ink detected by the temperature sensor exceeds a lower limit temperature which is lower than the upper limit temperature, the control portion operates the heating portion to heat the ink. This allows the temperature of the ink to be held in a range between the upper limit temperature and the lower limit temperature. Thus it is possible to hold constant the viscosity of the ink before the ink flows in the driving portion. Therefore, even when oil-based ink is used the viscosity of which varies considerably depending on the environmental temperature, it is possible to widen the range of temperature where printing is possible with stable printing quality.

In another embodiment of the inkjet printer, when the temperature of the ink detected by the temperature sensor is higher than a reference temperature, the control portion operates the cooling portion to cool the ink, and when the temperature of the ink detected by the temperature sensor is lower than the reference temperature, the control portion operates the heating portion to heat the ink. This allows the temperature of the ink to be held at the reference temperature. Thus it is possible to hold the viscosity of the ink more constant before the ink flows to the driving portion. Therefore, even in case oil-based ink is used the viscosity of which varies considerably depending on the environmental temperature, it is possible to widen the range of temperature where printing is possible with stable printing quality.

In another embodiment of the inkjet printer, when the heating portion is operated, the heating portion is made to generate heat by an electric signal outputted from the control portion to the heating portion and heats the ink, and, when the cooling portion is operated, the cooling portion is made to absorb heat by an electric signal outputted from the control portion to the cooling portion and cools the ink. This allows the temperature of the ink to be controlled in a far shorter time and in a far subtler way before the ink flows in the driving portion as compared with a case of indirect temperature control, using, for example, a water bath, an oil bath, or air cooling. Thus it is possible to easily hold constant the viscosity of the ink before the ink flows in the driving portion. Therefore, even in case oil-based ink is used the viscosity of which varies considerably depending on the environmental temperature, it is possible to widen the range of temperature where printing is possible with stable printing quality.

In another embodiment of the inkjet printer, a maximum value of the upper limit temperature is set to be 60° C. or below and a maximum value of the lower limit temperature is set to be 5° C. or more or below to the upper limit temperature. This allows the temperature of the ink to be held in a range between the upper limit temperature and the lower limit temperature before the ink flows in the driving portion. Thus it is possible to hold the viscosity of the ink before the ink flows in the driving portion between ink viscosity corresponding to the maximum value 60° C. of the upper limit temperature and the maximum value 5° C. of the lower limit temperature. It goes without saying that, when the difference between the upper limit temperature and the lower limit temperature is small, the range of fluctuation in the viscosity of the ink becomes small accordingly.

In another embodiment of the inkjet printer, a temperature control range is from 5° C. to 60° C., the reference temperature is set within the temperature control range such that the viscosity of the ink before the ink flows in the driving portion is in a range between 4 m Pa°s and 20 m Pa°s, and the temperature of the ink is controlled in a range of ±5° C. with the reference temperature being a center. This allows the temperature of the ink to be held constant at viscosity of the ink corresponding to the reference temperature in the range between 4 m Pa.s and 20 m Pa°s before the ink flows in the driving portion. Therefore, the viscosity of the ink can be adjusted more subtly than in the previous embodiments. It goes without saying that, when the range of ±5° C. is made narrower with the reference temperature being the center, the viscosity of the ink can be held more strictly constant before the ink flows in the driving portion. Further, it goes without saying that the present claim is also applicable to a case where such ink the viscosity of which does not vary depending on the temperature of the ink is used.

In another embodiment of the inkjet printer, the heating portion, the cooling portion, and the temperature sensor portion are provided at a position other than the driving portion on an ink supply path running from the ink containing portion through the ink passage to the driving portion built in the printing unit so as to be directly or indirectly in contact with ink flowing through the ink supply path. This allows the temperature of the ink to be measured by the temperature sensor before the ink flows in the driving portion. Therefore, the temperature of the ink can be controlled by the control portion using the heating portion and the cooling portion based on the result of the measurement before the ink flows in the driving portion.

In another embodiment of the inkjet printer, the temperature sensor portion is provided at a position in the printing unit other than the driving portion on the ink supply path so as to be directly or indirectly in contact with ink flowing through the ink supply path, and the heating portion and the cooling portion are provided at a position on the ink supply path which is closer to the ink containing portion than the temperature sensor portion. Since the temperature of the ink controlled by the heating portion and the cooling portion is measured just before the ink flows in the driving portion, the temperature of the ink just before the ink flows in the driving portion can be controlled by the control portion using the heating portion and the cooling portion based on the result of the measurement. Therefore, the viscosity of the ink flowing in the driving portion can be held constant even when the ink passage is elongated and the ink containing portion and the printing unit are separated from each other.

In another embodiment of the inkjet printer, the heating portion, the cooling portion, and the temperature sensor portion are provided at a position in the printing unit other than the driving portion on the ink supply path so as to be directly or indirectly in contact with ink flowing through the ink supply path, and the temperature sensor portion is provided at a position which is closer to the driving portion than the heating portion and the cooling portion. This allows the temperature of the ink controlled by the heating portion and the cooling portion to be measured just before the ink flows in the driving portion, and allows, in the vicinity, the temperature of the ink just before the ink flows in the driving portion to be controlled by the control portion using the heating portion and the cooling portion based on the result of the measurement. Therefore, the viscosity of the ink can be held constant more effectively even when the ink passage is elongated and the ink containing portion and the printing unit are separated from each other, since the environmental temperature has almost no influence on the temperature of the ink controlled by the heating portion and the cooling portion.

DETAILED DESCRIPTION OF THE PREFERED EMBODIMENTS

Figure 1:
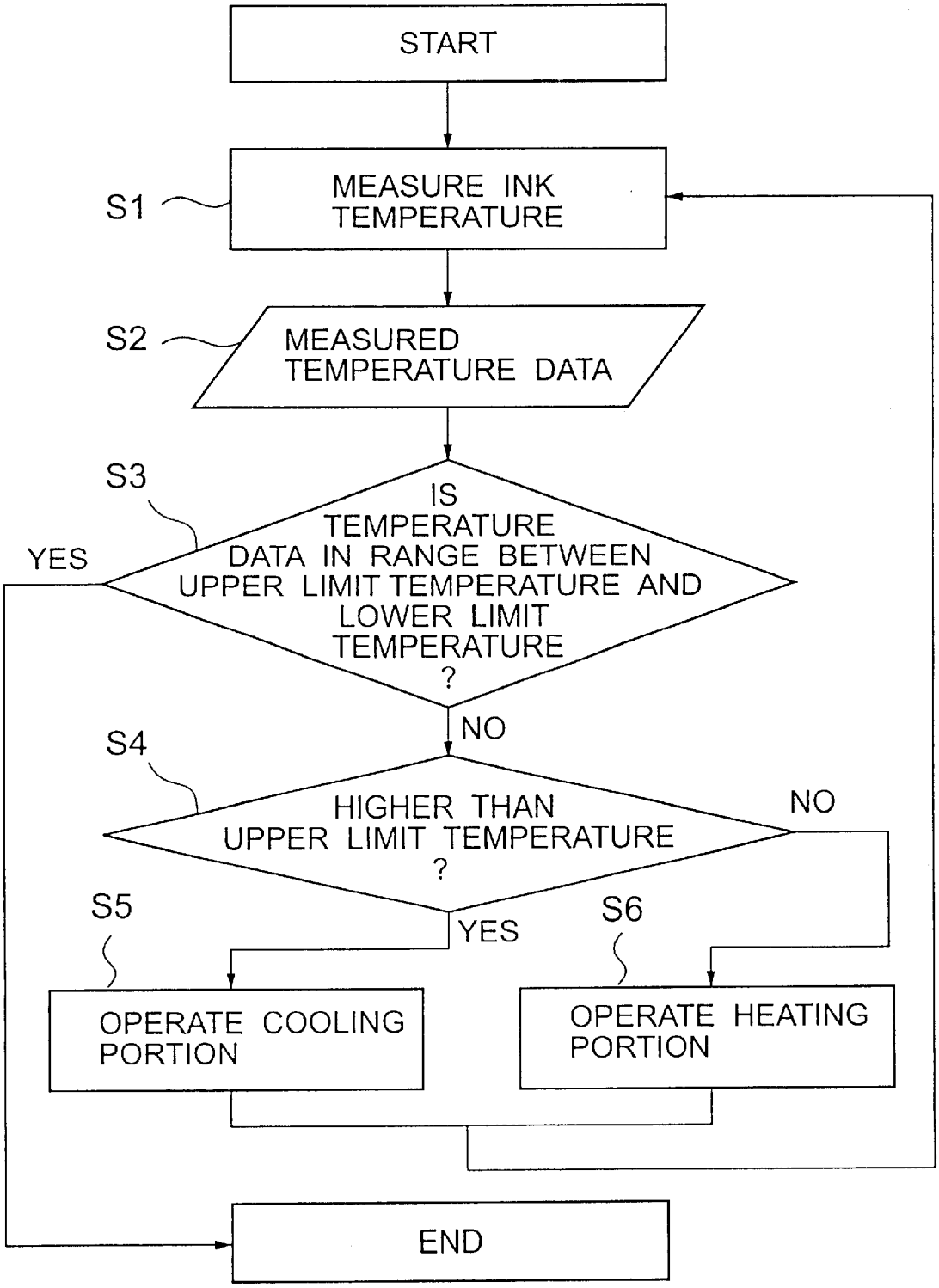
FIG. 1 is a flow chart of controlling the viscosity of ink.

FIG. 1 is a flow chart showing a first embodiment for controlling the temperature and the viscosity of ink according to the present invention. In steps S1 and S2, a temperature sensor 6 is, for example, a thermistor. The result of measurement of the temperature of ink is outputted from the thermistor in the form of, for example, the magnitude of electric current or voltage. In step S3, the outputted data is inputted, through a lead 14*a* connecting an external circuit for controlling the temperature of ink and the temperature sensor, to a CPU of the external circuit for controlling the temperature of ink. The CPU processes the inputted data according to arbitrary upper limit temperature and lower limit temperature which is set lower than the upper limit temperature stored in a storage medium of the external circuit for controlling the temperature of ink. In step S4, when the CPU determines that the temperature of the ink in the inputted data is higher than the upper limit temperature and the viscosity of the ink is too low to make the printing quality stable, output in the form of, for example, the magnitude of electric current or voltage is inputted from the external circuit for controlling the temperature of ink through a lead 14*b* connecting the external circuit for controlling the temperature of ink and a cooling portion to the cooling portion 7. Then, the process proceeds to step S5 where the ink is cooled by heat absorption by the cooling portion to make higher the viscosity of the ink. Here, the cooling portion 7 is a Peltier element or the like which absorbs heat due to Seebeck effect caused by, for example, application of electric current or voltage. Alternatively, in step S4, when the CPU determines that the temperature of the ink in the inputted data is lower than the lower limit temperature and the viscosity of the ink is too high to make the printing quality stable, the process proceeds to step S6 and output in the form of, for example, the magnitude of electric current or voltage is inputted to the heating portion from the external circuit for controlling the temperature of ink through a lead connecting the external circuit for controlling the temperature of ink and a heating portion. The ink is heated by heat generation by the heating portion 8 to make lower the viscosity of the ink. Here, the heating portion 8 is like a heating wire which generates heat by, for example, application of electric current or voltage. After such cooling or heating is performed, the temperature of the ink is measured again. If the result of the measurement is outside the range between the upper limit temperature and the lower limit temperature, the process goes back to step S1 and similar process is repeated. By this, the temperature of the ink is always held in the range between the upper limit temperature and the lower limit temperature, and, as a result, the viscosity of the ink before the ink flows in the driving portion 10 is always held at the viscosity corresponding to the range of the upper limit temperature and the lower limit temperature.

Figure 2:
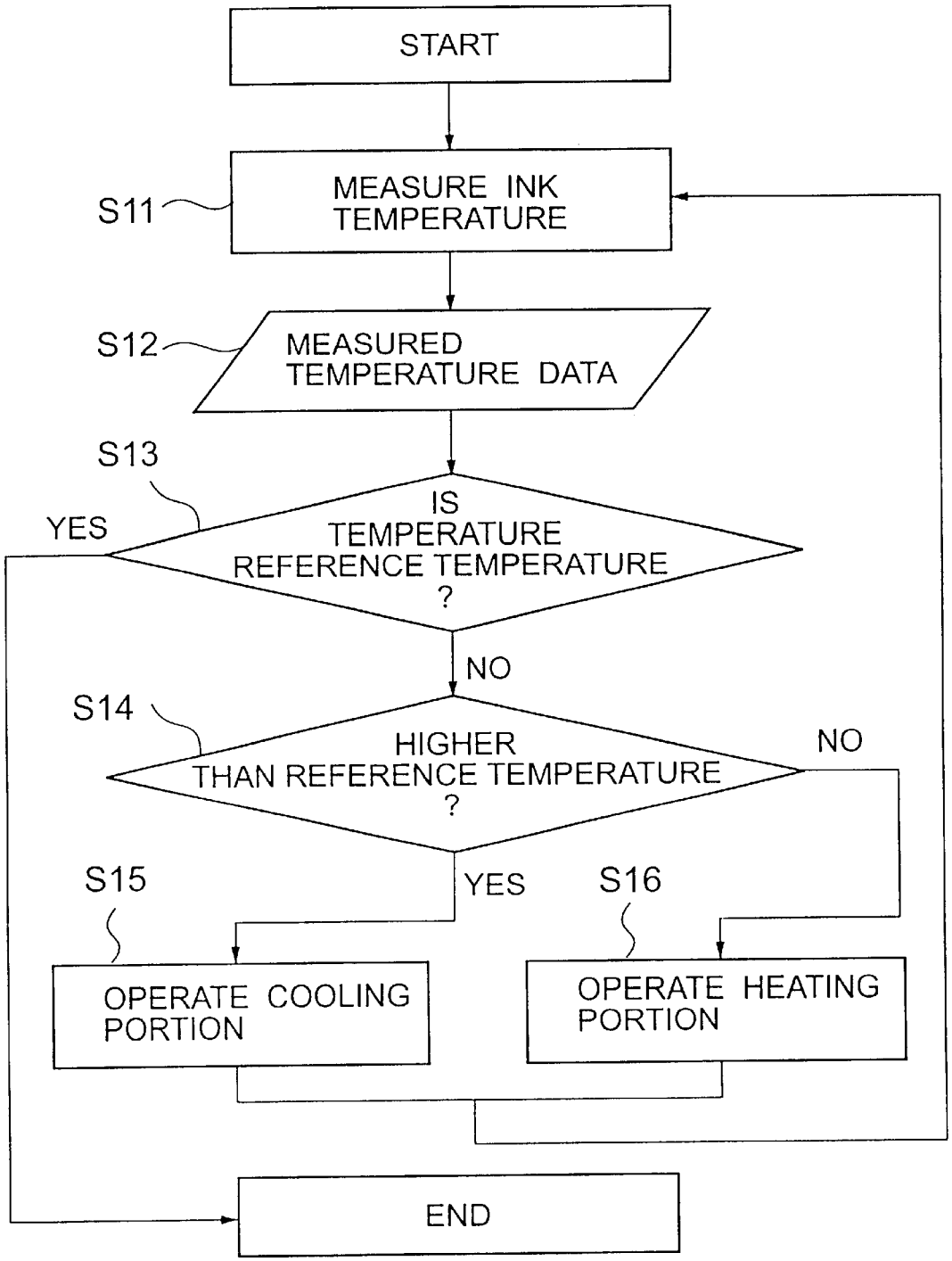
FIG. 2 is a flow chart of controlling the viscosity of ink.

FIG. 2 is a flowchart showing a second embodiment for controlling the temperature and the viscosity of ink according to the present invention. In steps S11 and S12, a temperature sensor 6 is, for example, a thermistor. The result of measurement of the temperature of ink is outputted from the thermistor in the form of, for example, the magnitude of electric current or voltage. In step S13, the outputted data is inputted, through a lead 14*a* connecting an external circuit for controlling the temperature of ink and the temperature sensor, to a CPU of the external circuit for controlling the temperature of ink. The CPU processes the inputted data according to arbitrary reference temperature stored in a storage medium of the external circuit for controlling the temperature of ink. In step S14, when the CPU determines that the temperature of the ink in the inputted data is lower than the reference temperature and the viscosity of the ink is too high to make the printing quality stable, the process proceeds to step S16 and output in the form of, for example, the magnitude of electric current or voltage is inputted from the external circuit for controlling the temperature of ink through a lead connecting the external circuit for controlling the temperature of ink and a heating portion to the heating portion 8. The ink is heated by heat generation of the heating portion to make lower the viscosity of the ink. Here, the heating portion 8 is like a heating wire which generates heat caused by, for example, application of, for example, electric current or voltage. Alternatively, in step S14, when the CPU determines that the inputted data is higher than the reference temperature and the viscosity of the ink is too low to make the printing quality stable, the process proceeds to step 15 and an output in the form of, for example, the magnitude of electric current or voltage, is inputted from the external circuit for controlling the temperature of ink through a lead connecting the external circuit for controlling the temperature of ink and a cooling portion to the cooling portion 7. The ink is cooled by heat absorption by the cooling portion 7 to make higher the viscosity of the ink. Here, the cooling portion is like a Peltier element which absorbs heat due to Seebeck effect caused by, for example, application of an electric current or a voltage. After such heating or cooling is performed, the temperature of the ink is measured again. If there is a difference between the result of the measurement and the reference temperature, the process goes back to step S11 and similar process is repeated. By this, the temperature of the ink is always held at the reference temperature, and as a result, the viscosity of the ink before the ink flows to the driving portion is always held at a viscosity corresponding to the reference temperature.

Figure 3:
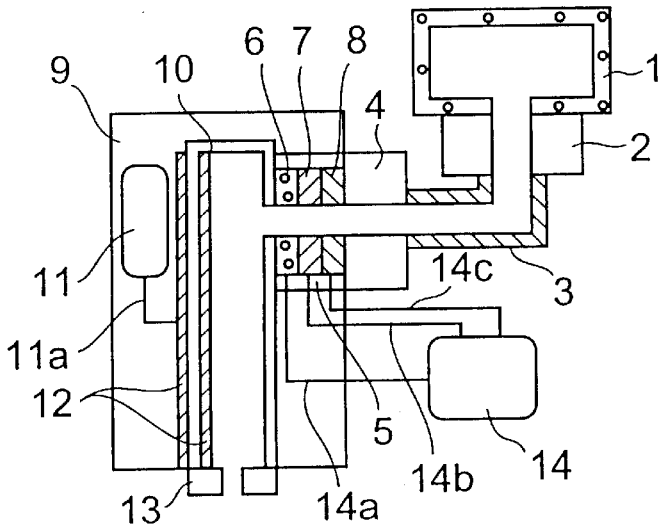
FIG. 3 is a longitudinal section diagram of an inkjet printer.

FIG. 3 is a longitudinal section diagram showing the first embodiment of the present invention. An actual structure is formed by connecting FIG. 3, but the present structure shows only a part of it. An ink containing portion 1 of an ink holder formed of plastic with detachable built-in plastic ink cartridge having ink to be supplied is connected through a connecting portion 2 for connecting the ink containing portion 1 and an ink passage to the ink passage 3. A printing unit 9 which, for example, corresponds to a print head, is connected through a connecting portion 4 for connecting the ink passage and the printing unit to the ink passage. Here, the ink passage is a main supply path for supplying the ink from the ink containing portion 1 to the printing unit 9, and is, for example, in a tubular form formed of a rubber tube or a lidded groove in a plate of plastic or metal. In the printing unit, a driving portion 10 is connected through a connecting portion 5 for connecting the printing unit and the driving portion to the printing unit. These form a supply path for supplying ink from the ink containing portion to the driving portion. The driving portion 10 has at its externally open end a nozzle 13 for expelling the ink formed of, for example, metal, and at least one surface of the walls of the driving portion formed of, for example, a piezo element has on both sides thereof an electrode 12 formed of, for example, aluminum. A control program stored in a storage medium of an ink ejection control circuit or external circuit 11 for controlling the expulsion of ink makes a CPU of the external circuit operate. By giving the electrode a control voltage from an external power source which is not shown through a lead 11*a* connecting the external circuit for controlling the expulsion of ink and the electrode, the wall surface of the driving portion having the electrode on both sides thereof is deformed regularly to generate in the driving portion pressure for expelling the ink from the nozzle. The series of operations are driven and controlled.

Further, a temperature sensor 6, a cooling portion 7, and a heating portion 8 in series are built in at the connecting portion for connecting the printing unit and the driving portion. The temperature sensor, the cooling portion, and the heating portion directly come in contact with the ink by, for example, the ink passing through the inside of their respective tubular closed surfaces. In addition, for the purpose of measuring the temperature of the ink after adjusting the temperature, the temperature sensor is provided at a position which is nearer than the cooling portion and the heating portion to the driving portion. Here, the temperature sensor is, for example, a thermistor. The result of measurement of the temperature of ink is outputted from the thermistor in the form of, for example, the magnitude of electric current or voltage. The output is inputted, through a lead 14*a* connecting a temperature control circuit or external circuit for controlling the temperature of ink and the temperature sensor, to a CPU of the external circuit for controlling the temperature of ink. The CPU processes the input according to a control program stored in a storage medium of the external circuit for controlling the temperature of ink. When the CPU determines from the input that the temperature of the ink is too low and the viscosity of the ink is too high to make the printing quality stable, output in the form of, for example, the magnitude of electric current or voltage is inputted from the external circuit for controlling the temperature of ink through a lead 14 connecting the external circuit for controlling the temperature of ink and the heating portion to the heating portion. The ink is heated by heat generation of the heating portion 8 to make lower the viscosity of the ink. Then, the expulsion condition is made stable and the printing quality is made stable. Here, the heating portion 8 is like a heating wire which generates heat caused by, for example, application of electric current or voltage. Alternatively, when the CPU determines from the input that the temperature of the ink is too high and the viscosity of the ink is too low to make the printing quality stable, output in the form of, for example, the magnitude of the electric current or the voltage is inputted from the external circuit for controlling the temperature of ink through a lead 14*b* connecting the external circuit for controlling the temperature of ink and the cooling portion to the cooling portion. The ink is cooled by heat absorption by the cooling portion to make higher the viscosity of the ink. Then, the expulsion condition or the like is made stable and the printing quality is made stable. Here, the cooling portion is like a Peltier element which absorbs heat due to Seebeck effect caused by, for example, application of electric current or voltage.

Figure 4:
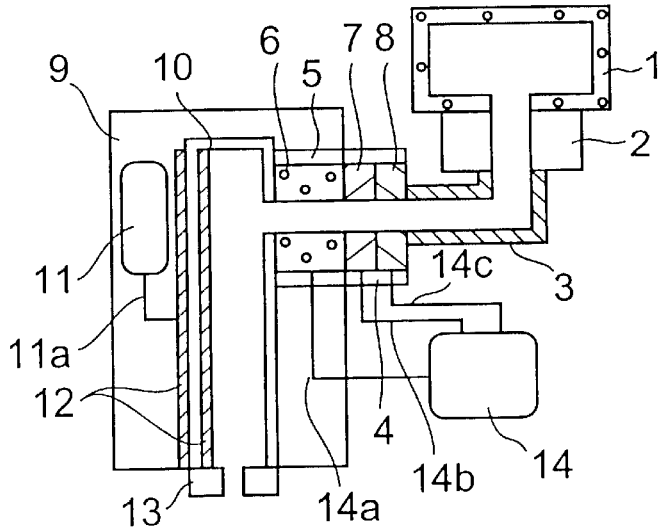
FIG. 4 is a longitudinal section diagram of an inkjet printer.

FIG. 4 is a longitudinal section diagram showing the second embodiment of the present invention. An actual structure is formed by connecting FIG. 4, but the present structure shows only a part of it. The operation methods and the functions of the respective components are the same as those of the first embodiment of the present invention. The present embodiment is different from the first embodiment only in the positions where the temperature sensor, the cooling portion, and the heating portion are provided. More specifically, the temperature sensor is built in at the connecting portion for connecting the printing unit and the driving portion, the cooling portion and the heating portion in series are built in at the connecting portion for connecting the ink passage and the printing unit, and the temperature sensor, the cooling portion, and the heating portion directly come in contact with the ink by, for example, the ink passing through the inside of their respective tubular closed surfaces.

Figure 5:
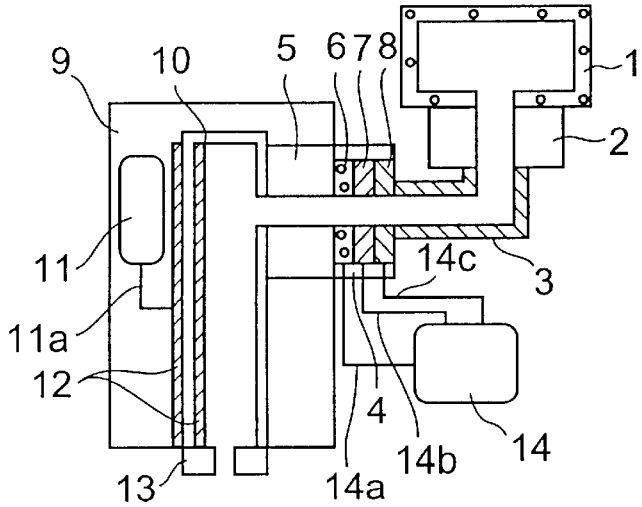
FIG. 5 is a longitudinal section diagram of an inkjet printer.

FIG. 5 is a longitudinal section diagram showing the third embodiment of the present invention. An actual structure is formed by connecting FIG. 5, but the present structure shows only a part of it. The operation methods and the functions of the respective components are the same as those of the first embodiment of the present invention. The present embodiment is different from the first embodiment only in the positions where the temperature sensor 6, the cooling portion 7, and the heating portion 8 are provided. More specifically, the temperature sensor, the cooling portion, and the heating portion in series are built in at the connecting portion for connecting the ink passage and the printing unit, the temperature sensor, the cooling portion, and the heating portion directly come in contact with the ink by, for example, the ink passing through the inside of their respective tubular closed surfaces, and, for the purpose of measuring the temperature of the ink after adjusting the temperature, the temperature sensor 6 is provided at a position which is nearer than the cooling portion and the heating portion to the driving portion.

Figure 6:
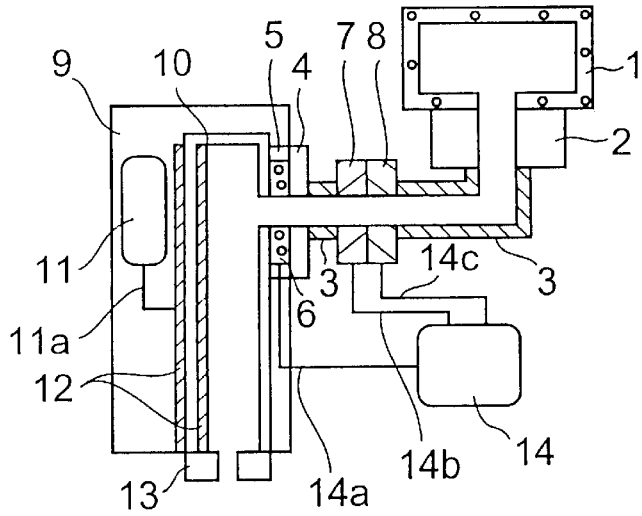
FIG. 6 is a longitudinal section diagram of an inkjet printer.

FIG. 6 is a longitudinal section diagram showing the fourth embodiment of the present invention. An actual structure is formed by connecting FIG. 6, but the present structure shows only a part of it. The operation methods and the functions of the respective components are the same as those of the first embodiment of the present invention. The present embodiment is different from the first embodiment only in the positions where the temperature sensor, the cooling portion, and the heating portion are provided. More specifically, the temperature sensor 6 is built in at the connecting portion for connecting the printing unit and the driving portion, the cooling portion 7 and the heating portion 8 in series are provided on the way in the ink passage, and the temperature sensor, the cooling portion, and the heating portion directly come in contact with the ink by, for example, the ink passing through the inside of their respective tubular closed surfaces.

Figure 7:
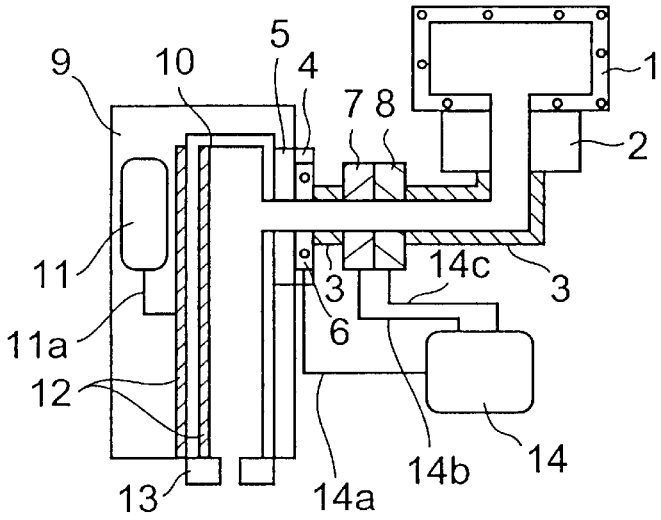
FIG. 7 is a longitudinal section diagram of an inkjet printer.

FIG. 7 is a longitudinal section diagram showing the fifth embodiment of the present invention. An actual structure is formed by connecting FIG. 7, but the present structure shows only a part of it. The operation methods and the functions of the respective components are the same as those of the first embodiment of the present invention. The present embodiment is different from the first embodiment only in the positions where the temperature sensor, the cooling portion, and the heating portion are provided. More specifically, the temperature sensor is built in at the connecting portion for connecting the ink passage and the printing unit, the cooling portion and the heating portion in series are provided on the way in the ink passage, and the temperature sensor, the cooling portion, and the heating portion directly come in contact with the ink by, for example, the ink passing through the inside of their respective tubular closed surfaces.

Figure 8:
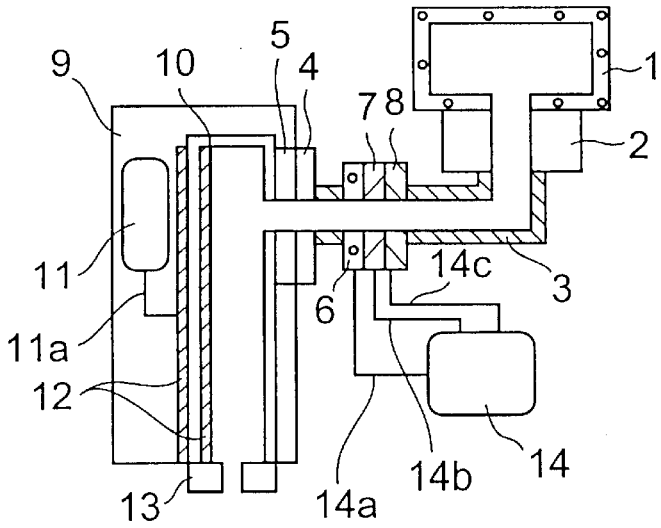
FIG. 8 is a longitudinal section diagram of an inkjet printer.

FIG. 8 is a longitudinal section diagram showing the sixth embodiment of the present invention. An actual structure is formed by connecting FIG. 8, but the present structure shows only a part of it. The operation methods and the functions of the respective components are the same as those of the first embodiment of the present invention. The present embodiment is different from the first embodiment only in the positions where the temperature sensor, the cooling portion, and the heating portion are provided. More specifically, the temperature sensor 6, the cooling portion 7, and the heating portion 8 in series are provided on the way in the ink passage, the temperature sensor, the cooling portion, and the heating portion directly come in contact with the ink by, for example, the ink passing through the inside of their respective tubular closed surfaces, and for the purpose of measuring the temperature of the ink after adjusting the temperature, the temperature sensor is provided at a position which is nearer than the cooling portion and the heating portion to the driving portion.

Figure 9:
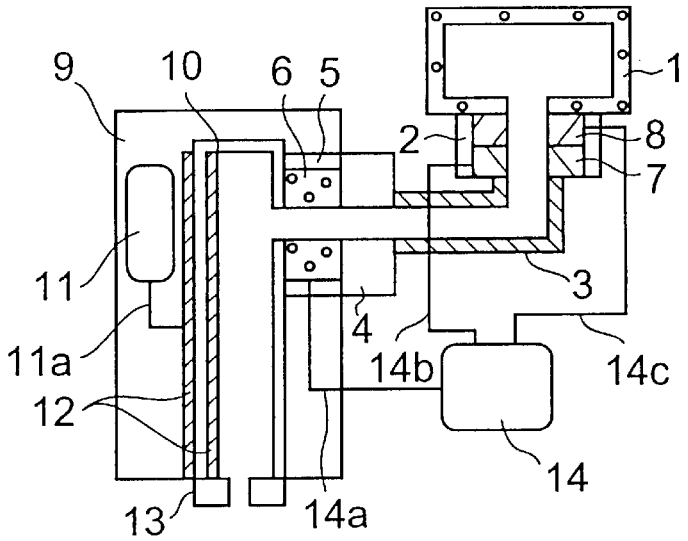
FIG. 9 is a longitudinal section diagram of an inkjet printer.

FIG. 9 is a longitudinal section showing the seventh embodiment of the present invention. An actual structure is formed by connecting FIG. 9, but the present structure shows only a part of it. The operation methods and the functions of the respective components are the same as those of the first embodiment of the present invention. The present embodiment is different from the first embodiment only in the positions where the temperature sensor 6, the cooling portion 7, and the heating portion 8 are provided. More specifically, the temperature sensor is built in at the connecting portion for connecting the printing unit and the driving portion, the cooling portion and the heating portion in series are built in at the connecting portion for connecting the ink containing portion and the ink passage, and the temperature sensor 6, the cooling portion 7, and the heating portion 8 directly come in contact with the ink by, for example, the ink passing through the inside of their respective tubular closed surfaces.

Figure 10:
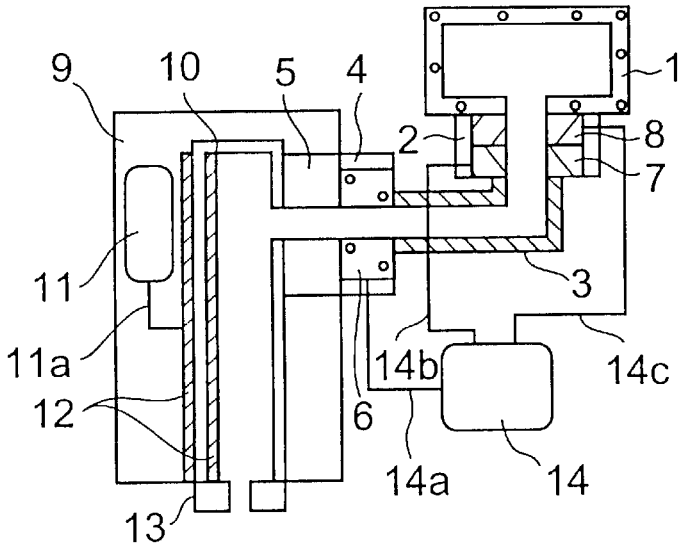
FIG. 10 is a longitudinal section diagram of an inkjet printer.

FIG. 10 is a longitudinal section diagram showing the eighth embodiment of the present invention. An actual structure is formed by connecting FIG. 10, but the present structure shows only a part of it. The operation methods and the functions of the respective components are the same as those of the first embodiment of the present invention as shown in FIG. 3. The present embodiment is different from the first embodiment only in the positions where the temperature sensor, the cooling portion, and the heating portion are provided. More specifically, the temperature sensor is built in at the connecting portion for connecting the ink passage and the printing unit, the cooling portion and the heating portion in series are built in at the connecting portion for connecting the ink containing portion and the ink passage, and the temperature sensor, the cooling portion, and the heating portion directly come in contact with the ink by, for example, the ink passing through the inside of their respective tubular closed surfaces.

Figure 11:
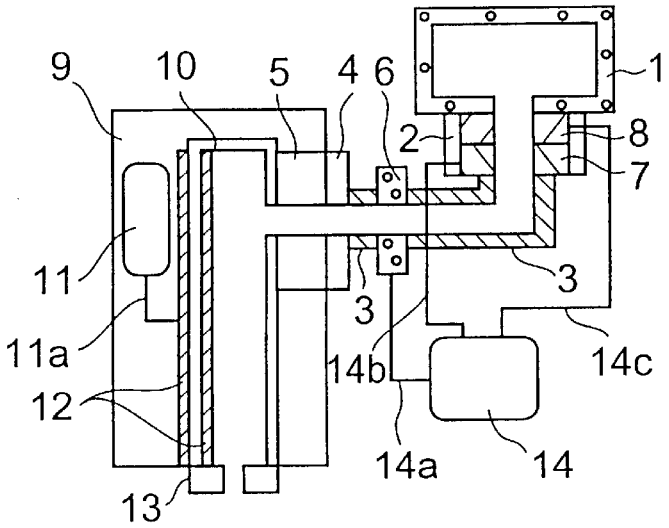
FIG. 11 is a longitudinal section diagram of an inkjet printer.

FIG. 11 is a longitudinal section diagram showing the ninth embodiment of the present invention. An actual structure is formed by connecting FIG. 11, but the present structure shows only a part of it. The operation methods and the functions of the respective components are the same as those of the first embodiment of the present invention. The present embodiment is different from the first embodiment only in the positions where the temperature sensor, the cooling portion, and the heating portion are provided. More specifically, the temperature sensor is provided on the way in the ink passage, the cooling portion and the heating portion in series are built in at the connecting portion for connecting the ink containing portion and the ink passage, and the temperature sensor, the cooling portion, and the heating portion directly come in contact with the ink by, for example, the ink passing through the inside of their respective tubular closed surfaces.

Figure 12:
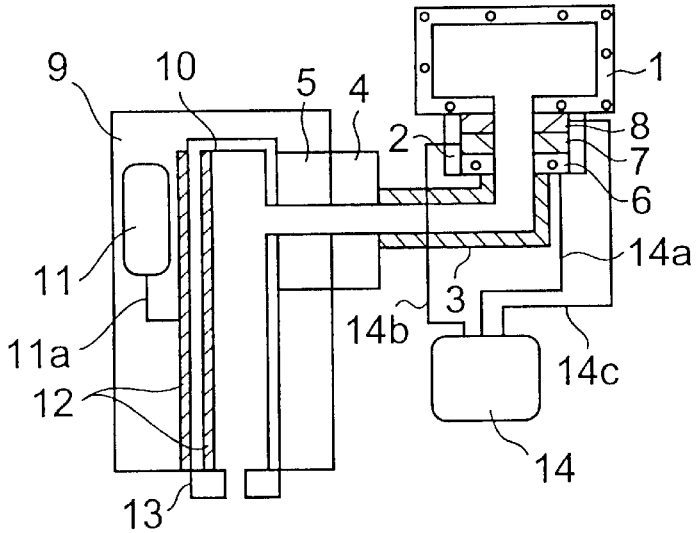
FIG. 12 is a longitudinal section diagram of an inkjet printer.
Figure 13:
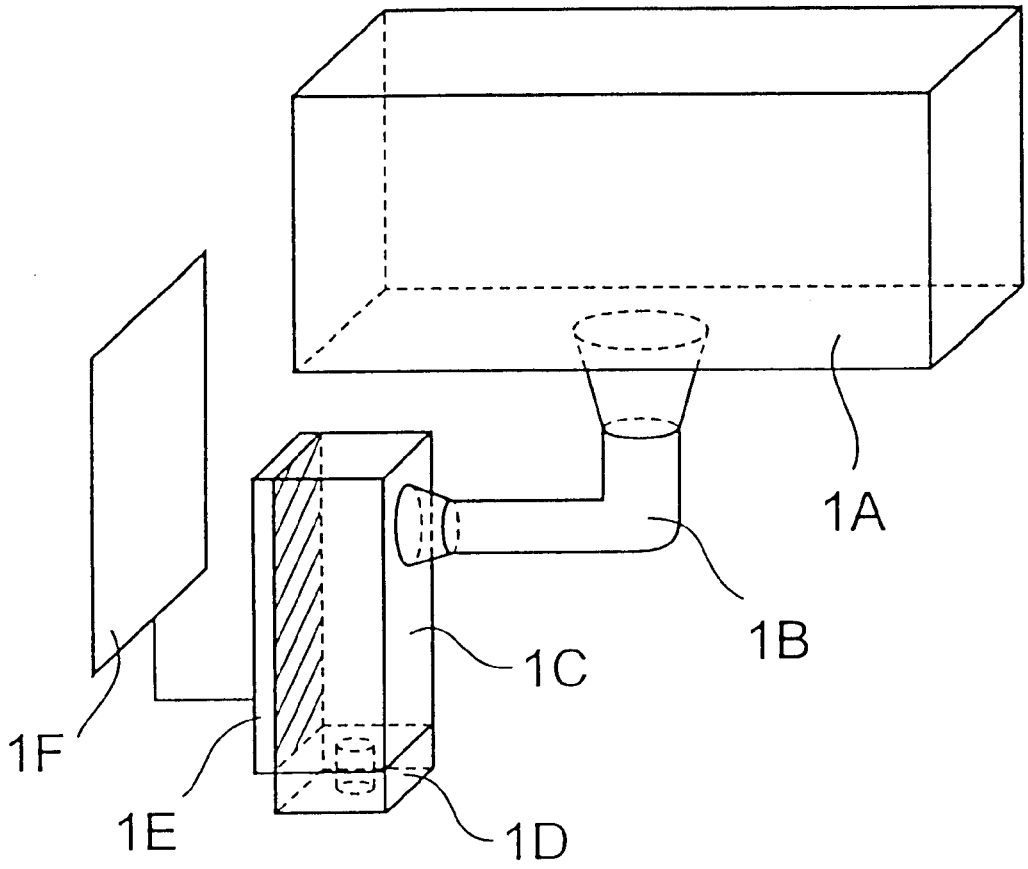
FIG. 13 PRIOR ART
FIG. 13 is a perspective view of a conventional inkjet printer.

FIG. 12 is a longitudinal section diagram showing the tenth embodiment of the present invention. An actual structure is formed by connecting FIG. 12, but the present structure shows only a part of it. The operation methods and the functions of the respective components are the same as those of the first embodiment of the present invention. The present embodiment is different from the first embodiment only in the positions where the temperature sensor, the cooling portion, and the heating portion are provided. More specifically, the temperature sensor, the cooling portion, and the heating portion in series are built in at the connecting portion for connecting the ink containing portion and the ink passage, and the temperature sensor, the cooling portion, and the heating portion come directly in contact with the ink by, for example, the ink passing through the inside of the respective tubular closed surfaces, and for the purpose of measuring the temperature of the ink after adjusting the temperature, the temperature sensor is provided at a position which is nearer to the driving portion than the cooling portion and the heating portion.

It is to be noted that any element having a function to output as an electric signal the result of measurement of the temperature of the ink to the external circuit for controlling the temperature of ink can be used as the temperature sensor, any element having a function to cool the ink under control by an electric signal outputted from the external circuit for controlling the temperature of ink can be used in the cooling portion, and any element having a function to heat the ink under control by an electric signal outputted from the external circuit for controlling the temperature of ink can be used in the heating portion.

Further, in the embodiments shown in FIGS. 3, 4, 6, and 9, since the temperature of the ink is measured immediately before the ink flows to the driving portion, these are especially effective when applied to a case where the viscosity of the ink varies considerably depending on the temperature of the ink.

The present invention is implemented in the embodiments described in the above, and has the following effects.

Since the temperature of ink can be controlled before the ink flows to a driving portion of a printer, the viscosity of the ink flowing to the driving portion can be made stable. This prevents the initial temperature of the ink from being uniquely determined by the environmental temperature, and even in a case the viscosity of the ink to be used varies considerably depending on the environmental temperature, for example, in a case the ink is oil-based, the viscosity of the ink before the ink flows to the driving portion of the printer may be held constant to make the printing quality stable, and further, the range of temperature where printing is possible with stable printing quality can be widened.

Further, since the driving portion minutely vibrates as a method of heating the ink, application of a method where heat generating action of a capacitor can be avoided, and the deterioration of the product life of the driving portion due to such a heating method can be prevented.

What is claimed is:

1. An inkjet printer comprising:

an ink containing portion for containing ink;

a printing unit having a driving portion having a nozzle for ejecting ink contained in the ink containing portion;

a first control circuit for driving and controlling the driving portion so that a pressure for ejecting the ink from the nozzle is generated in the driving portion;

an ink passage disposed between the ink containing portion and the driving portion for supplying ink contained in the ink containing portion to the driving portion via an ink supply path extending from the ink containing portion through the ink passage to the driving portion;

a heating portion disposed in the ink supply path for heating the ink supplied to the driving portion;

a cooling portion for cooling the ink supplied to the driving portion, the cooling portion being disposed in the ink supply path at a position closer to the driving portion than the heating portion;

a temperature sensor portion for detecting the temperature of the ink supplied to the driving portion, the temperature sensor portion being disposed in the ink supply path at a position closer to the driving portion than the cooling portion; and a second control circuit for controlling at least one of the heating portion and the cooling portion in accordance with the temperature of the ink detected by the temperature sensor portion to adjust and control the temperature of the ink before it is supplied to the driving portion;

wherein the second control circuit outputs an electric signal to the heating portion to control the heating portion to generate heat to heat the ink so that a viscosity of the ink is maintained constant before the ink is supplied to the driving portion, and wherein the second control to control the cooling portion to absorb heat to cool the ink so that the viscosity of the ink is maintained constant before the ink is supplied to the driving portion.

2. An inkjet printer for printing by ejecting ink on a recording medium, the inkjet printer comprising:

an ink containing portion for containing ink;

a printing unit having a driving portion having a nozzle for ejecting ink contained in the ink containing portion;

a first control circuit for driving and controlling the driving portion so that a pressure for ejecting the ink from the nozzle is generated in the driving portion;

an ink passage disposed between the ink containing portion and the driving portion for supplying ink contained in the ink containing portion to the driving portion via an ink supply path extending from the ink containing portion through the ink passage to the driving portion;

a heating portion disposed in the ink supply path for heating the ink supplied to the driving portion;

a cooling portion for cooling the ink supplied to the driving portion, the cooling portion being disposed in the ink supply path at a position closer to the driving portion than the heating portion;

a temperature sensor portion for detecting the temperature of the ink supplied to the driving portion, the temperature sensor portion being disposed in the ink supply path at a position closer to the driving portion than the cooling portion; and a second control circuit for controlling at least one of the heating portion and the cooling portion in accordance with the temperature of the ink detected by the temperature sensor portion to adjust and control the temperature of the ink before it is supplied to the driving portion;

wherein the second control circuit controls the cooling portion to cool the ink when the temperature of the ink detected by the temperature sensor portion is higher than a first temperature so that a viscosity of the ink is maintained constant before the ink is supplied to the driving portion and controls the heating portion to heat the ink when the temperature of the ink detected by the temperature sensor portion is lower than a second temperature lower than the first temperature so that the temperature of the ink is maintained in a temperature range between the first and second temperatures, and wherein the second control circuit controls the heating portion and the cooling portion so that a maximum value of the first temperature of the ink before the ink is supplied to the driving portion is 60° C. or below and the second temperature is in a range from 5° C. to the maximum value of the first temperature.

3. An inkjet printer for printing by ejecting ink on a recording medium, the inkjet printer comprising:

an ink containing portion for containing ink;

a printing unit having a driving portion having a nozzle for ejecting ink contained in the ink containing portion;

a first control circuit for driving and controlling the driving portion so that a pressure for ejecting the ink from the nozzle is generated in the driving portion;

an ink passage disposed between the ink containing portion and the driving portion for supplying ink contained in the ink containing portion to the driving portion via an ink supply path extending from the ink containing portion through the ink passage to the driving portion;

a heating portion disposed in the ink supply path for heating the ink supplied to the driving portion;

a cooling portion for cooling the ink supplied to the driving portion, the cooling portion being disposed in the ink supply path at a position closer to the driving portion than the heating portion;

a temperature sensor portion for detecting the temperature of the ink supplied to the driving portion, the temperature sensor portion being disposed in the ink supply path at a position closer to the driving portion than the cooling portion; and a second control circuit for controlling at least one of the heating portion and the cooling portion in accordance with the temperature of the ink detected by the temperature sensor portion to adjust and control the temperature of the ink before it is supplied to the driving portion;

wherein the second control circuit controls the cooling portion to cool the ink when the temperature of the ink detected by the temperature sensor portion is higher than a reference temperature so that a viscosity of the ink is maintained constant before the ink is supplied to the driving portion and controls the heating portion to heat the ink when the temperature of the ink detected by the temperature sensor portion is lower than the reference temperature so that the temperature of the ink is maintained at the reference temperature, the reference temperature being in a temperature control range of 5° C. to 60° C. and the viscosity of the ink before the ink is supplied to the driving portion is in a range of 4 m Pa·s and 20 Pa·s, and wherein the second control circuit controls the heating portion and the cooling portion so that the temperature of the ink is maintained within a range of ±5° C. from the reference temperature to adjust the viscosity of the ink.

4. An inkjet printer for printing by ejecting ink on a recording medium, the inkjet printer comprising: an ink containing portion for containing ink; a printing unit having a driving portion having a nozzle for ejection ink contained in the ink containing portion; a first control circuit for driving and controlling the driving portion so that a pressure for ejecting the ink from the nozzle is generated in the driving portion; an ink passage disposed between the ink containing portion and the driving portion for supplying ink contained in the ink containing portion to the driving portion via an ink supply path extending from the ink containing portion through the ink passage to the driving portion; a connecting portion for connecting the ink passage to the printing unit; a heating portion disposed in the ink supply path for heating the ink supplied to the driving portion; a cooling portion for cooling the ink supplied to the driving portion, the cooling portion being disposed in the ink supply path at a position closer to the driving portion than the heating portion; a temperature sensor portion for detecting the temperature of the ink supplied to the driving portion, the temperature sensor portion being disposed in the ink supply path at a position closer to the driving portion than the cooling portion; and a second control circuit for controlling at least one of the heating portion and the cooling portion in accordance with the temperature of the ink detected by the temperature sensor portion to adjust and control the temperature of the ink before it is supplied to the driving portion; wherein the heating portion, the cooling portion and the temperature sensor portion are disposed at the connecting portion.

5. An inkjet printer as claimed in claim 4; wherein the heating portion, the cooling portion and the temperature sensor portion directly contact the ink supplied to the driving portion.

6. An inkjet printer for printing by ejecting ink on a recording medium, the inkjet printer comprising: an ink containing portion for containing ink; a printing unit having a driving portion having a nozzle for ejecting ink contained in the ink containing portion; a first control circuit for driving and controlling the driving portion so that a pressure for ejecting the ink from the nozzle is generated in the driving portion; an ink passage disposed between the ink containing portion and the driving portion for supplying ink contained in the ink containing portion to the driving portion via an ink supply path extending from the ink containing portion through the ink passage to the driving portion; a connecting portion for connecting the ink passage to the ink supply path for heating the ink supplied to the driving portion; a cooling portion for cooling the ink supplied to the driving portion, the cooling portion being disposed in the ink supply path at a position closer to the driving portion than the heating portion; a temperature sensor portion for detecting the temperature of the ink supplied to the driving portion, the temperature sensor portion being disposed in the ink supply path at a position closer to the driving portion than the cooling portion; and a second control circuit for controlling at least one of the heating portion and the cooling portion in accordance with the temperature of the ink detected by the temperature sensor portion to adjust and control the temperature of the ink before it is supplied to the driving portion; wherein the heating portion, the cooling portion and the temperature sensor portion are disposed at the connecting portion.

7. An inkjet printer as claimed in claim 6; wherein the heating portion, the cooling portion and the temperature sensor portion directly contact the ink supplied to the driving portion.

8. An inkjet printer comprising:

an ink containing portion for containing ink;

a printing unit having a driving portion having a nozzle for ejecting ink contained in the ink containing portion;

a first control circuit for driving and controlling the driving portion so that a pressure for ejecting the ink from the nozzle is generated in the driving portion;

an ink passage disposed between the ink containing portion and the driving portion for supplying ink contained in the ink containing portion to the driving portion via an ink supply path extending from the ink containing portion through the ink passage to the driving portion;

a heating portion disposed in the ink supply path for direct contact with the ink to heat the ink supplied to the driving portion;

a cooling portion disposed in the ink supply path for direct contact with the ink to cool the ink supplied to the driving portion;

a temperature sensor portion disposed in the ink supply path for direct contact with the ink to detect a temperature of the ink supplied to the driving portion; and a second control circuit for controlling at least one of the heating portion and the cooling portion in accordance with the temperature of the ink detected by the temperature sensor portion to adjust and control the temperature of the ink before it is supplied to the driving portion of the printing unit;

wherein the second control circuit controls the cooling portion to cool the ink when the temperature of the ink detected by the temperature sensor portion is higher than a first temperature so that a viscosity of the ink is maintained constant before the ink is supplied to the driving portion and controls the heating portion to heat the ink when the temperature of the ink detected by the temperature sensor portion is lower than a second temperature lower than the first temperature so that the temperature of the ink is maintained in a temperature range between the first and second temperatures, and wherein the second control circuit controls the heating portion and the cooling portion so that a maximum value of the first temperature of the ink before the ink is supplied to the driving portion is 60° C. or below and the second temperature is in a range from 5° C. to the maximum value of the first temperature.

9. An inkjet printer comprising:

an ink containing portion for containing ink, a printing unit having a driving portion having a nozzle for ejecting ink contained in the ink containing portion;

a first control circuit for driving and controlling the driving portion so that a pressure for ejecting the ink from the nozzle is generated in the driving portion;

an ink passage disposed between the ink containing portion and the driving portion for supplying ink contained in the ink containing portion to the driving portion via an ink supply path extending from the ink containing portion through the ink passage to the driving portion;

a heating portion disposed in the ink supply path for direct contact with the ink to heat the ink supplied to the driving portion;

a cooling portion disposed in the ink supply path for direct contact with the ink to cool the ink supplied to the driving portion;

a temperature sensor portion disposed in the ink supply path for direct contact with the ink to detect a temperature of the ink supplied to the driving portion; and a second control circuit for controlling at least one of the heating portion and the cooling portion in accordance with the temperature of the ink detected by the temperature sensor portion to adjust and control the temperature of the ink before it is supplied to the driving portion of the printing unit;

wherein the second control circuit controls the cooling portion to cool the ink when the temperature of the ink detected by the temperature sensor portion is higher than a reference temperature so that a viscosity of the ink is maintained constant before the ink is supplied to the driving portion and controls the heating portion to heat the ink when the temperature of the ink detected by the temperature sensor portion is lower than the reference temperature so that the temperature of the ink is maintained at the reference temperature, the reference temperature being in a temperature control range of 5° C. to 60° C. and the viscosity of the ink before the ink is supplied to the driving portion is in a range of 4 m Pa·s and 20 m Pa·s, and wherein the second control circuit controls the heating portion and the cooling portion so that the temperature of the ink is maintained within a range of ±5° C. from the reference temperature to adjust the viscosity of the ink.

10. An inkjet printer comprising:

an ink containing portion for containing ink;

a printing unit having a driving portion having a nozzle for ejecting ink contained in the ink containing portion;

a first control circuit for driving and controlling the driving portion so that a pressure for ejecting the ink from the nozzle is generated in the driving portion;

an ink passage disposed between the ink containing portion and the driving portion for supplying ink contained in the ink containing portion to the driving portion via an ink supply path extending from the ink containing portion through the ink passage to the driving portion;

a heating portion disposed in the ink supply path for direct contact with the ink to heat the ink supplied to the driving portion;

a cooling portion disposed in the ink supply path for direct contact with the ink to cool the ink supplied to the driving portion;

a temperature sensor portion disposed in the ink supply path for direct contact with the ink to detect a temperature of the ink supplied to the driving portion; and a second control circuit for controlling at least one of the heating portion and the cooling portion in accordance with the temperature of the ink detected by the temperature sensor portion to adjust and control the temperature of the ink before it is supplied to the driving portion of the printing unit;

wherein the second control circuit outputs an electric signal to the heating portion to control the heating portion to generate heat to heat the ink so that a viscosity of the ink is maintained constant before the ink is supplied to the driving portion, and wherein the second control circuit outputs an electric signal to the cooling portion to control the cooling portion to absorb heat to cool the ink so that the viscosity of the ink is maintained constant before the ink is supplied to the driving portion.

* * * * *